US006381840B2

(12) United States Patent
Ide

(10) Patent No.: US 6,381,840 B2
(45) Date of Patent: May 7, 2002

(54) CONNECTING STRUCTURE FOR COVERED WIRES

(75) Inventor: Tetsuro Ide, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/756,795

(22) Filed: Jan. 10, 2001

Related U.S. Application Data

(62) Division of application No. 09/260,547, filed on Mar. 2, 1999.

(30) Foreign Application Priority Data

Mar. 3, 1998 (JP) ..... P10-50991

(51) Int. Cl.[7] ..... H01K 3/30
(52) U.S. Cl. ..... 29/872; 29/860; 29/868; 174/84 R
(58) Field of Search ..... 29/800, 868, 872, 29/873; 174/84 R

(56) References Cited

U.S. PATENT DOCUMENTS 807,747 A 12/1905 Kling
3,643,008 A 2/1972 Brazee
3,897,127 A 7/1975 Haitmanek
5,584,122 A * 12/1996 Kto et al.
5,869,784 A 2/1999 Shinchi
5,906,044 A * 5/1999 Fujii et al.
5,922,993 A * 7/1999 Ide et al.
5,925,202 A * 7/1999 Ide et al.
5,929,384 A * 7/1999 Ide et al.
5,947,770 A * 9/1999 Shinchi
5,954,549 A * 9/1999 Shinchi
5,959,252 A * 9/1999 Ide et al.
6,004,170 A * 12/1999 Kato et al.
6,046,407 A * 4/2000 Ide
6,072,123 A * 6/2000 Ide et al.
6,072,124 A * 6/2000 Kato et al.
6,087,589 A * 7/2000 Ide

OTHER PUBLICATIONS

United Kingdom Search Report, May 1999.

* cited by examiner

*Primary Examiner*—Carl J. Arbes
(74) *Attorney, Agent, or Firm*—Finnegan, Henderson, Farabow, Garrett, & Dunner, L.L.P.

(57) ABSTRACT

A connecting structure of covered wires is provided. A ground wire 2 is overlaid by a shield wire 1 such that the wires cross each other. Respective overlapping portions of the wires 1, 2 are interposed between an upper resin tip 13 and a lower resin tip 14. Next, the upper and lower resin tips 13, 14 are oscillated with ultrasonic waves while compressing the upper and lower resin tips 13, 14 from the outside. Consequently, respective outside rinds 1*d*, 2*b* of the wires 1,2 are molten for removal, so that a braided wire 1*c* comes into electrical contact with a core line 2*a*. The upper resin tip 13 isS provided, on a periphery of the butt face, with a projection 13*b*. One the other hand, the lower resin tip 14 has a recess 14*b* formed on a periphery of the butt face, for engagement with the projection 13*b*. Owing to the provision of the projection 13*b* and the recess 14*b*, it is possible to exclude a possibility that the upper resin tip 13 deviates from the lower resin tip 14 during the ultrasonic oscillation.

4 Claims, 2 Drawing Sheets

CONNECTING STRUCTURE FOR COVERED WIRES

This is a division of application Ser. No. 09/260,547, filed Mar. 2, 1999, which is incorporated herein by reference.

BACKGROUND OF THE INVENTION

1. Field of the Invention

The present invention relates to a connecting structure for covered wires where their respective conductors are connected to each other by oscillating respective insulating covers of the wires with ultrasonic waves. More particularly, it relates to a connecting structure which is effective to connect a shield wire with a ground wire.

2. Description of the Related Art

Generally, it is complicated and troublesome to handle a shield wire having a braided wire coaxially disposed around a core line (or core lines) with the deteriorated workability in using the shield wire. As an effective measure for improving the deteriorated workability, there is provided a connecting structure for wires which takes advantage of inside heating due to the ultrasonic oscillation in Japanese Unexamined Patent Publication (kokai) No. 7-320842.

In the publication, there are shown two kinds of covered wires. One is a shield wire which comprises a core line, an inside insulating rind arranged outside the core line, a braided wire as a shield conductor arranged outside the inside insulating rind, and an outside insulating rind. The other is a ground wire consisting of a core line and an outside resinous rind arranged outside the core line.

According to the disclosed method of connecting the braided wire of the shield wire connected to a connector, to the core line of the ground wire also connected to the connector, in front of the connector, the ground wire is first overlaid on the shield wire so that they cross each other at a connection point. Next, the overlapping portions are interposed between upper and lower resin tips. Then, while compressing the upper and lower resin tips from the outside, they are subjected to ultrasonic oscillation by making use of an ultrasonic horn and an anvil. Consequently, both of the outside rinds of the shield wire and the ground wire are molten for elimination, so that the braided wire of the shield wire comes into electrical contact with the core line of the ground wire. Simultaneously, the upper and lower resin tips are mutually welded to each other in order to seal the vicinity of the above connecting point. Note, in the modification, there is a case that the upper and lower resin tips are respectively provided, on bearing faces thereof, with wire-accommodating shallow grooves for positioning the shield wire.

However, the so-obtained connecting structure has a problem in that if the positions of the upper and lower resin tips deviated from each other during the ultrasonic oscillation for welding, the welding strength between the upper and lower resin tips deteriorated due to the reduced welding area. In addition, such a positional deviation between the upper and lower resin tips would cause the connecting condition between the braided wire of the shield wire and the core line of the ground wire to be varied widely, so that the stability in electrical performance would deteriorated, too.

SUMMARY OF THE INVENTION

Under such a circumstance, it is therefore an object of the present invention to provide a connecting structure for covered wires, which is capable of preventing the mutual deviation in position between the upper resin tip and the lower resin tip at the ultrasonic oscillation, whereby the welding strength and the stability in electrical performance can be ensured.

The object of the present invention described above can be accomplished by a connecting structure for covered wires, comprising:

a first covered wire having a first conductor covered with a first resinous cover;

a second covered wire having a second conductor covered with a second resinous cover, the second conductor being electrically connected with the first conductor of the first covered wire cross each other; and an upper resin tip and a lower resin tip between which an electrical connecting part of the first and second conductors and the surroundings are interposed, the upper resin tip being welded to the lower resin tip while interposing the first and second covered wires between the upper resin tip and the lower resin tip;

wherein either one of the upper and lower resin tips is provided, on a periphery of a butt face thereof to be abutted against the other resin tip, with a projecting rim, while the other of the upper and lower resin tips is provided, on a periphery of a butt face thereof being abutted against the other resin tip, with a recessed rim for engagement with the projecting rim;

whereby the upper and lower resin tips can be located and integrated by the engagement of the projecting rim with the recessed rim.

With the above-mentioned connecting structure, owing to the engagement of the projecting rim with the recessed rim, it is possible to exclude a possibility that the upper resin tip deviates from the lower resin tip during the ultrasonic oscillation. Therefore, it is possible to ensure a constant welding area, whereby the reliability in connecting strength can be improved. In addition, since there is no deviation in contact between the first conductor and the second conductor, the electrical connecting performance can be stabilized.

In the present invention, preferably, the first covered wire is a shield wire, while the second wire is a ground wire and wherein the first conductor is a shield conductor of the shield wire, while the second conductor is a core line of the ground wire.

With the above-mentioned connecting structure, since the upper resin tip does not deviate from the lower resin tip during the ultrasonic oscillation, it is possible to exclude a possibility of deviating a contact between the braided wire and the core line, whereby the electrical connecting performance can be stabilized, too.

In the connecting structure of the invention, preferably, the second covered wire is withdrawn to the exterior of the upper and lower resin tips, across the projecting rim and the recessed rim in engagement with the projecting rim.

In this case, with such a withdrawal of the second covered wire, the second conductor is bent irregularly in the welded structure, so that the drawing resistance of the second covered wire can be enhanced.

In the present invention, preferably, each of the upper and lower resin tips is provided, on its butt face being abutted against the other resin tip, with a wire receiving groove which has a semi-circular cross section having a diameter substantially equal to a diameter of the first covered wire.

According to the preferred connecting structure, since the diameter of the wire receiving groove is substantially equal to the diameter of the first covered wire, it is possible to weld the upper resin tip to the lower resin tip in the wrapping manner without compressing the first resinous cover of the first covered wire. Thus, since there is no possibility that the first resinous cover of the first covered wire is torn or broken by the upper or lower resin tip, the fixing force between the upper and lower resin tips and the first covered wire can be enhanced. In addition, it is possible to exclude a possibility that the first covered wire exposes the first conductor in the vicinity of the upper and lower resin tips.

According to the invention, there is also provided a method of producing a connecting structure for covered wires, the method comprising the steps of:

preparing a first covered wire having a first conductor covered with a first resinous cover and a second covered wire having a second conductor covered with a second resinous cover;

overlaying the second covered wire on the first covered wire cross each other;

interposing respective overlapping portions of the first and second covered wires between an upper resin tip and a lower resin tip; and oscillating the upper and lower resin tips with ultrasonic waves while compressing the upper and lower resin tips from the outside, whereby the first and second resinous covers of the first and second covered wires are molten for removal thereby to bring the first conductor of the first covered wire into electrical contact with the second conductor of the second covered and simultaneously, the upper and lower resin tips are mutually welded to each other thereby to seal up the surroundings of a contact between the first conductor and the second conductor;

wherein either one of the upper and lower resin tips is provided, on a periphery of a butt face thereof to be abutted against the other resin tip, with a projecting rim, while the other of the upper and lower resin tips is provided, on a periphery of a butt face thereof to be abutted against the other resin tip, with a recessed rim for engagement with the projecting rim;

whereby the upper and lower resin tips can be located and integrated by the engagement of the projecting rim with the recessed rim.

In the above-mentioned method, preferably, the first covered wire is a shield wire, while the second wire is a ground wire and wherein the first conductor is a shield conductor of the shield wire, while the second conductor is a core line of the ground wire.

In the above-mentioned method, preferably, the second covered wire is withdrawn to the exterior of the upper and lower resin tips, across the projecting rim and the recessed rim in engagement with the projecting rim.

In the above-mentioned method, preferably, each of the upper and lower resin tips is provided, on its butt face being abutted against the other resin tip, with a wire receiving groove which has a semi-circular cross section having a diameter substantially equal to a diameter of the first covered wire.

These and other objects and features of the present invention will become more fully apparent from the following description and appended claims taken in conjunction with the accompany drawings.

BRIEF DESCRIPTION OF THE DRAWINGS

FIGS. 1A and 1B are views showing resin tips constituting a connecting structure in accordance with an embodiment of the present invention, in which FIG. 1A is a perspective view showing an upper resin tip turned over and FIG. 1B is a perspective view showing a lower resin tip; and FIGS. 2A and 2B are views showing the connecting structure of the embodiment, in which FIG. 2A is a perspective view of the connecting structure and FIG. 2B is a cross sectional view of the connecting structure, taken along a line II*b*—II*b* of FIG. 2A.

DESCRIPTION OF THE PREFERRED EMBODIMENT

U.S. Pat. No. 5,584,122, Kato et al, issued on Dec. 17, 1996 is characterized by reference herein in its entirety. One embodiment of the present invention will be described with reference to the drawings hereinafter.

Figure 1A:
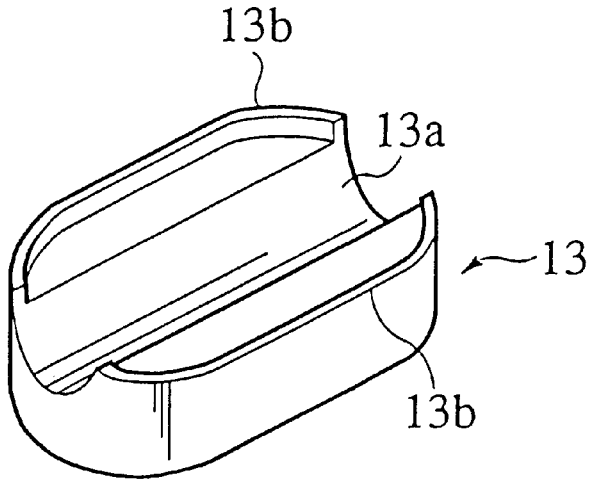
Figure 1B:
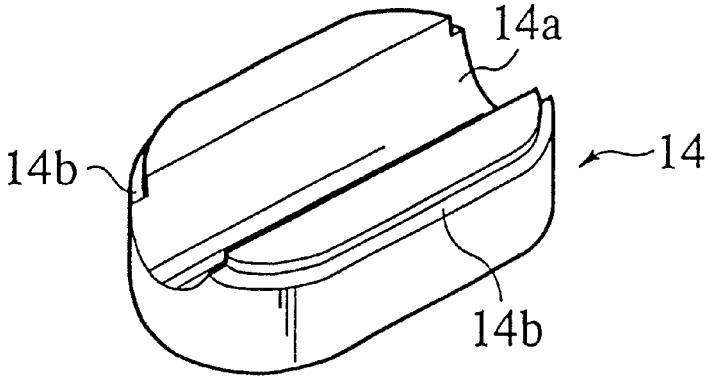

FIGS. 1A and 1B show resin tips constituting the connecting structure in accordance with the embodiment of the present invention. FIG. 1A shows an upper resin tip 13 turned over, while FIG. 1B shows a lower resin tip 14.

Each of the resin tips 13, 14 is constituted by a plate body having a profile of an elongated circle in its plan view. Formed on respective butt faces (i.e. mutual contact faces being welded) of the upper and lower resin tips 13, 14 are wire receiving grooves 13*a*, 14*a* each of which extends along a direction of the long axis of the elongated circle and has a semicircular cross section of a diameter generally equal to that of an outside rind 1*d* of the shield wire 1.

According to the embodiment, the upper resin tip 13 has a projection 13*b* (projecting rim) formed on a periphery of the butt face against the lower resin tip 14. Note, the projection 13*b* is constituted by opposing projecting parts which interpose the wire receiving groove 13*a* therebetween. On the other hand, the lower resin tip 14 has a recess 14*b* (recessed rim) formed on a periphery of the butt face against the upper resin tip 13, for engagement with the projection 13*b*. The recess 14*b* is constituted by opposing lowered parts which interpose the wire receiving groove 14*a* therebetween. Owing to the engagement of the projection 13*b* with the recess 14*b*, it is possible to prevent the upper and lower resin tips 13, 14 from being shifted from each other during the ultrasonic oscillation.

Figure 2A:
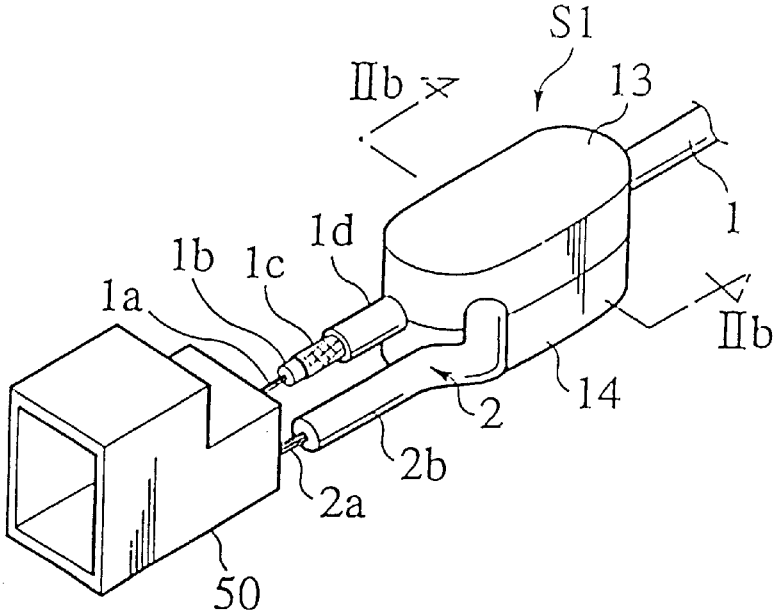

In order to connect the shield wire 1 to the ground wire 2, it is firstly carried out to lay the ground wire 2 on the shield wire 1 so as to cross each other at a connecting part. Next, the overlapping portions of the wires 1, 2 are interposed between the upper resin tip 13 and the lower resin tip 14. Under such a condition, the overlapping portions of the wires 1, 2 are subjected to the ultrasonic oscillation by making use of an ultrasonic horn and an anvil while compressing the upper and lower resin tips 13, 14 from the outside. Consequently, both of the outside rind 1*d* of the shield wire 1 and an outside rind 2*b* of the round wire 2 are molten for removal, so that a braided wire 1*c* of the shield wire 1 comes into electrical contact with a core line(s) 2*a* of the ground wire 2. Simultaneously, the upper and lower resin tips 13, 14 are mutually welded to each other thereby seal up an area surroundings the above connecting point. In this way, a connecting part S1 between the shield wire 1 and the ground wire 2can be obtained, as shown in FIGS. 2A and 2B.

According to the resultant connecting structure, since the projection 13*b* of the upper resin tip 13 engages with the recess 14*b* of the lower resin tip 14, both tips 13, 14 are integrated into one body without being shifted from each other. Thus, owing to the provision of the projection 13*b* and the recess 14*b*, it is possible to ensure an appropriate welding area, whereby a proper welding strength can be ensured. In addition, with no deviation in position between the resin tips 13, 14, it is possible to manage the performance of a contact between the braided wire 1*c* and the core line 2*a* proper.

Figure 2B:
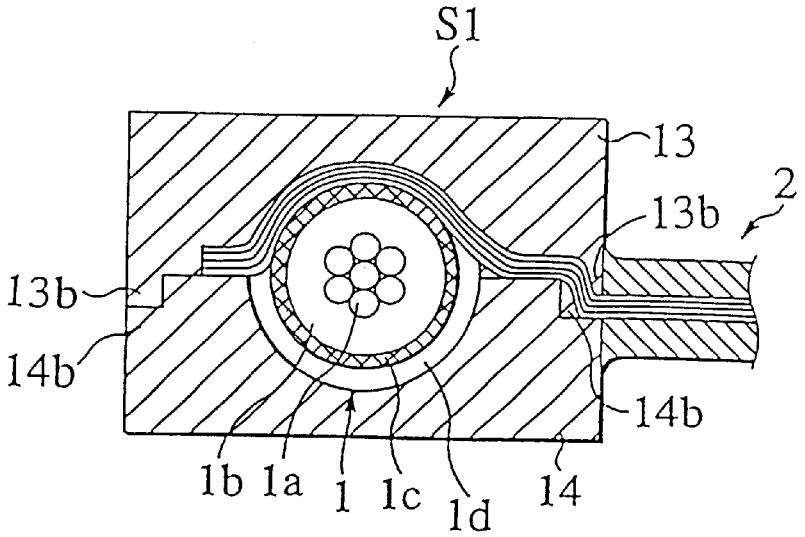

Furthermore, as shown in FIG. 2B, since the core line 2*a* of the ground wire 2 is arranged so as to cross the projection 13*b* and the recess 14*b* in the engagement condition, the core line 2*a* is partially bent in a position where the projection 13*b* engages the recess 14. That is, since the bending part is produced in the core line 2*a,* it is possible to increase the drawing resistance of the ground wire 1.

Finally, it will be understood by those skilled in the art that the foregoing description is related to one preferred embodiment of the disclosed connecting structure, and that various changes and modifications may be made to the present invention without departing from the spirit and scope thereof. For example, in the modification, the projection 13*b* may be provided on the lower resin tip 14 while forming the recess 14*b* on the upper resin tip 13, conversely.

What is claimed is:

1. A method of producing a connecting structure for covered wires, the method comprising the steps of:

preparing a first covered wire having a first conductor covered with a first resinous cover and a second covered wire having a second conductor covered with a second resinous cover;

preparing upper and lower resin tips, one of the upper and lower resin tips being provided, on an entire periphery of a butt thereof to be abutted against the other resin tip, with a projecting rim and the other of the upper and lower resin tips being provided, on an entire periphery of a butt face thereof to be abutted against the other resin tip, with a recessed rim;

overlaying the second covered wire on the first covered wire cross each other;

interposing respective overlapping portions of the first and second covered wires between the upper resin tip and the lower resin tip;

integrating the upper and lower resin tips by engaging the projecting rim with the recessed rim; and oscillating the upper and lower resin tips with ultrasonic waves while compressing the upper and lower resin tips from the outside, whereby the first and second resinous covers of the first and second covered wires are molten for removal thereby to bring the first conductor of the first covered wire into electrical contact with the second conductor of the second covered wire and simultaneously, the upper and lower resin tips are mutually welded to each other thereby to seal up an area surrounding a contact between the first conductor and the second conductor.

2. A method as claimed in claim 1, wherein the first covered wire is a shield wire, while the second wire is a ground wire and wherein the first conductor is a shield conductor of the shield wire, while the second conductor is a core line of the ground wire.

3. A method as claimed in claim 1, further comprising the step of arranging the second covered wire across the projecting rim and the recessed rim with a portion of the second covered wire withdrawn to the exterior of the upper and lower resin tips.

4. A method as claimed in claim 1, wherein each of the upper and lower resin tips is provided, on its butt face being abutted against the other resin tip, with a wire receiving groove which has a semi-circular cross section having a diameter substantially equal to a diameter of the first covered wire.

* * * * *

UNITED STATES PATENT AND TRADEMARK OFFICE

CERTIFICATE OF CORRECTION

PATENT NO. : 6,381,840 B2
DATED : May 7, 2002
INVENTOR(S) : Tetsuro Ide

It is certified that error appears in the above-identified patent and that said Letters Patent is hereby corrected as shown below:

Title page,
Item [57], ABSTRACT,
Line 11, "isS" should read -- is --.
Line 12, "One" should read -- On --.

Signed and Sealed this

Seventeenth Day of September, 2002

*Attest:*

*Attesting Officer*

JAMES E. ROGAN
*Director of the United States Patent and Trademark Office*